United States Patent [19]

Margen et al.

[11] 4,210,203

[45] Jul. 1, 1980

[54] HEAT EXCHANGER APPARATUS

[75] Inventors: Peter H. E. Margen; Rolf P. Näslund, both of Nyköping, Sweden

[73] Assignee: Aktiebolaget Atomenergi, Stockholm, Sweden

[21] Appl. No.: 841,473

[22] Filed: Oct. 12, 1977

[30] Foreign Application Priority Data

Oct. 21, 1976 [SE] Sweden ..... 7611720

[51] Int. Cl.² ..... F28D 7/10

[52] U.S. Cl. ..... 165/163; 122/510; 122/250 R

[58] Field of Search ..... 165/156, 110, DIG. 11, 165/163; 285/49, 68 R; 122/250 R, 510

[56] References Cited

U.S. PATENT DOCUMENTS

| | | | |
|---|---|---|---|
| 311,839 | 2/1885 | Kirkaldy | 165/163 |
| 698,140 | 4/1922 | Rey et al. | 122/250 R |
| 3,482,946 | 12/1969 | Shirk | 122/510 X |
| 3,499,484 | 3/1970 | Lanzoni | 165/163 X |
| 4,007,712 | 2/1977 | Fimger et al. | 122/510 |

*Primary Examiner*—Samuel Scott
*Assistant Examiner*—Theophil W. Streule, Jr.
*Attorney, Agent, or Firm*—Burns, Doane, Swecker & Mathis

[57] ABSTRACT

There is provided a heat exchanger apparatus comprising a plurality of mutually identical heat exchanger coils. Each coil has the shape of a cup. The coils are placed in close relationship on both sides of a base plate which blocks a flow channel. The base plate exhibits a plurality of orifices, and a coil is placed over each orifice with its rim in contact with the base plate and surrounding the edge of the orifice, but only one coil is assigned to each orifice. Adjacent coils on opposite sides of the base plate are stagger so that their rims overlap each other without covering any part of the orifice assigned to the adjacent coil on the opposite side of the base plate.

13 Claims, 8 Drawing Figures

HEAT EXCHANGER APPARATUS

The invention relates to a heat exchanger apparatus of the kind comprising a plurality of heat exchanging units each consisting of a sparsely wound, hollow, substantially circular pipe coil, closed or covered at one end, every coil having a substantially identical outside diameter and inside diameter at its other end, in its axial direction the coil being straight or tapering towards its closed or covered end, said coil being placed with its open end on a plate provided with a plurality of orifices, said plate screening off a flow passage, and each orifice, the diameter of which is substantially equal to or less than the inside diameter of the coil, being covered by a coil.

Heat exchanger apparatus for transferring large amounts of heat from one medium to another, as between water and air, have earlier often been specially made for a given use. Such specially made structures will be extremely expensive, for natural reasons. It is possible to conceive, per se, parallel connection of a plurality of smaller standardized heat exchanger units, but this in its turn has resulted in the heat exchanger apparatus becoming too voluminous. The invention has now the object of supplying directions as to how a plurality of identical heat exchanger units can be coordinated while minimizing the space requirements of the heat exchanger apparatus thus produced.

In the present invention one can particularly utilize the heat exchanger units disclosed in out patent application No. 681,471 which has issued as U.S. Pat. No. 4,108,240 on Aug. 22, 1978.

The heat exchanger apparatus of the invention is distinguished by features that coils are placed on both sides of the baseplate, that the coils on one side of the baseplate are arranged with equal centre-to-centre distances in parallel first rows, that the coils on the other side of the baseplate are arranged with said centre-to-centre distances in parallel second rows, that the first and the second rows are parallel and alternating, that the coils of the first row are displaced substantially half the said centre-to-centre distance in the direction of the row relative to those in the second row, and that adjacent opposing coils overlap each other substantially without covering any parts of the orifice assigned to each in the plate.

The invention, as well as embodiments thereof, is defined in detail in the appended subordinate claims.

What distinguishes the invention is thus that a heat exchanger apparatus is put together from a plurality of heat exchanger units, preferably coupled in parallel, and which are commonly substantially identical. Each heat exchanger unit consists of a sparsely wound, hollow, substantially circular pipe coil which is closed off or covered at one end. These coils are placed each with its open end over an orifice arranged in a baseplate. In plan, adjacent coils on either side of the baseplate overlap each other, although a requirement is that a coil on one side of the baseplate shall not substantially cover any part of the orifice in the baseplate over which the coil on the other side of the baseplate is placed. The baseplate is situated so that it screens off a flow passage. An air stream moving forward in the flow passage towards the baseplate will then flow radially through a coil from the outside and into the hollow part or cavity of the coil and from there through the orifice in the baseplate and further out between the coils on the other side of the baseplate. At the same time, air will flow into the spaces between the coils facing towards the air stream, and further through orifices in the base plate and into the cavity in a coil placed on the other side of the plate. From there, air will flow radially outwardly through the wall of the coil and out into the spaces between adjacent coils, and from there out to the other side of the heat exchanger apparatus. It may thus be said that the heat exchanging coils placed on either side of the plate are coupled in parallel. On the outlet side of the heat exchanger apparatus, an air stream in the space between adjacent coils facing the same way will depart, and this air stream consists of the sum of the air stream passing out from the interior of a coil on the inlet side of the plate and the air streams departed from the surfaces of the heat exchanging coils on the outlet side of the apparatus, facing towards the space between adjacent coils facing the same way on the outlet side of the plate. In the case where the coils are arranged in a "triangluar" configuration, i.e. three adjacent coils facing the same way are placed in the apices of an equilateral triangle, the total flow will be 1.5 times the flow through an individual coil. In the case where the coils are arranged in a "quadratic" configuration, the total flow will be equal to 2 times the flow through an individual coil.

So as not to introduce flow disturbances, the cross-sectional area of the space between adjacent coils facing the same way should be respectively greater than 1.5 and 2 times the area of the orifices in the baseplate.

When the chief criteria for providing a region within which the coils can be closely packed to different intensities have thus been defined, it is suitable to more closely define the limiting criteria applicable for avoiding the situation where a coil on one side of the plate screens off some substantial portion of the orifice in the plate for an adjacent coil on the other side of the plate. Similarly, it is suitable to define the conditions applicable for avoiding the introduction of disturbances in the flow through the apparatus. For this reason we have defined some relationships in the appended claims between the outside diameter and the inside diameter of the coils on one hand, and the pattern for laying out the coils on the other.

In order to simplify the notation of these relationships it is convenient to define some symbols.

- d = the cavity diameter of the coil at the other end thereof,
- D = the outside diameter of the coil at the second other end thereof,
- $C_1$ = Centre-to-centre distance between adjacent opposing coils,
- $C_2$ = Centre-to-centre distance between coils facing the same way in a row,
- R = Centre-to-centre distance between a first row and an adjacent second row.

A wide first relationship within the inventive improvement is defined as $$\frac{D+d}{2} \leqq C_1 < D \quad D \leqq C_2 < D\sqrt{3} \quad \frac{D\sqrt{3}}{6} \leqq R < \frac{D}{2}$$

a second narrower relationship within the frameworks of the first relationship is $$C_1 = \frac{D+d}{2} \quad C_2 = D \quad R = \frac{D\sqrt{3}}{6} \quad d \leqq \frac{D(2-\sqrt{3})}{\sqrt{3}}$$

A third narrower relationship within the frameworks of the first relationship is $$\frac{D+d}{2} \leqq C_1 < D \quad D \leqq C_2 < D\sqrt{2} \quad \frac{D}{2} \leqq R < \frac{D}{\sqrt{2}}$$

A fourth narrower relationship within the frameworks of the third relationship is $$C_1 = \frac{D+d}{2} \quad C_2 = D \quad R = \frac{D}{2} \quad d \leqq D(\sqrt{2}-1)$$

A fifth narrower relationship within the frame works of the third relationship is $$C_1 = \frac{D+d}{2} \quad C_2 = \frac{D3\sqrt{2}}{2} \quad R = \frac{D3}{4\sqrt{2}} \quad d \leqq \frac{D}{2}$$

A sixth narrower relationship within the frameworks of the first or second relationship is $$d^2 \leqq \frac{8}{3\pi}\left(\frac{3C_2R}{2} - \frac{\pi D^2}{8}\right)$$

A seventh narrower relationship within the frameworks of the third, fourth or fifth relationship is $$d^2 \leqq \frac{2}{\pi}\left(2C_2R - \frac{\pi D^2}{4}\right)$$

The embodiment according to the second relationship is illustrated in the enclosed FIGS. 1 and 2.

The embodiment according to the fourth relationship is illustrated in the enclosed FIGS. 3 and 4.

The embodiment according to the fifth relationship is illustrated in the enclosed FIGS. 5 and 6.

The specific embodiment of connection in parallel of the individual coils in no way constitutes a part of the present invention, and the connection of the individual coils to the inlet and outlet piping respectively can be executed according to prevailing technology, although we do prefer the utilization of a "plug-in" technique so that separate coils can easily be exchanged without any great effort.

The invention will now be described more closely in the following while using examples and referring to the attached drawing.

Figure 2:
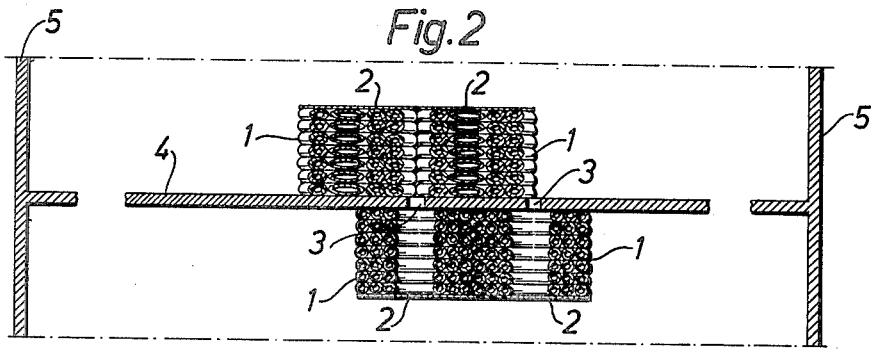
FIG. 2 shows a section taken along the line II—II in FIG. 1.

In FIG. 2 there is shown an air passage 5 which is screened off by means of a separating wall or baseplate 4. The baseplate 4 has a plurality of orifices 3. A plurality of similar heat exchanging coils 1 are placed on both sides of the plate 4. Each coil 1 consists of one or more pipes which are wound to a cylindrical coil with an outside diameter D and an inside diameter d. Each coil 1 is covered by a disc 2 at its end facing away from the baseplate.

Figure 1:
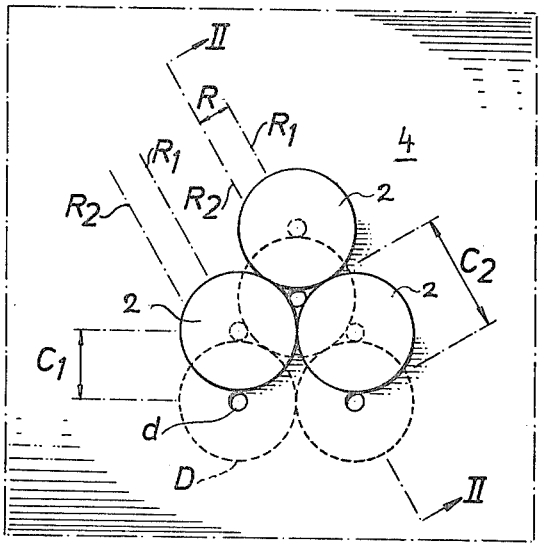
FIG. 1 shows a schematic view of a first example on the mutual placing of heat exchanging coils in an apparatus according to the invention.

In FIGS. 1 and 2 the coils are placed in triangular configuration, i.e. adjacent coils facing the same way are centered on the apices of an equilateral triangle.

The coils facing the same way on the upper side of the plate are placed in rows $R_1$. Rows $R_1$ are parallel but the coils 1 in adjacent rows $R_1$ are dispaced a distance corresponding to substantially the half the centre-to-centre distance between the coils in a row. The coils on the underside of the plate 4 are placed in parallel rows $R_2$, the coils on adjacent rows $R_2$ being displaced substantially half the centre-to-centre distance between the coils in the rows $R_2$. Rows $R_1$ and $R_2$ are parallel and alternating as is apparent from FIG. 1. The center-to-center distance between adjacent coils facing in opposite directions is $C_1$ in the plane of the baseplate 4. The centre-to-centre distance between adjacent coils facing in the same direction is $C_2$. In FIG. 1 the outer contour of the coils 1 on the underside of the baseplate 4 is shown with dashed lines. In FIG. 1 the orifices 3 in the baseplate 4 which are covered by coils 1 placed on top of the plate 4 are indicated with dashed lines. In the embodiment according to FIGS. 1 and 2 the inside diameters of the coils should be equal to or less than approximately $0.15 \times D$, to prevent a coil on one side of the plate screening off some part of the inlet opening to the cavity in a coil on the other side of the plate. The triangular space formed between three adjacent coils facing the same way should have an area which is greater than $1.5 \times$ the area of the cavity in a coil. This is because the total flow through said triangular space is equal to the flow through the cavity of a coil $+ 1/6$ of the outflow from each of the coils facing the same way and adjacent to the triangular space.

Figure 3:
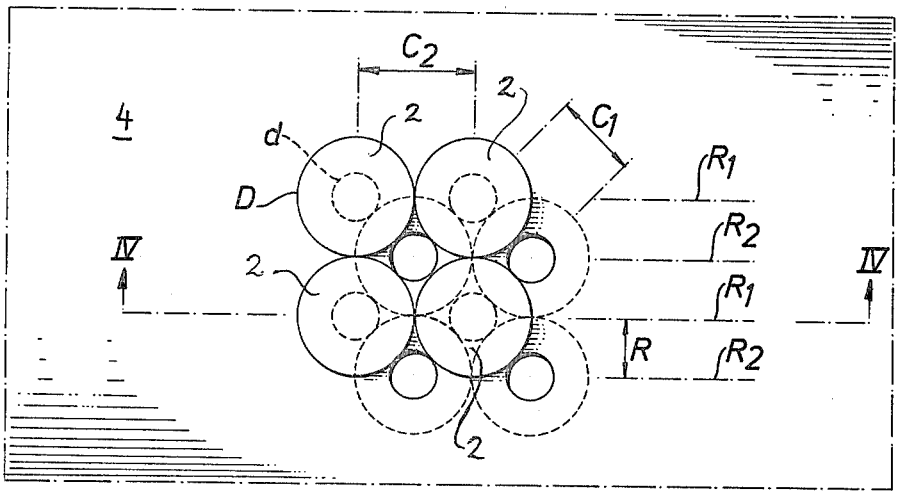
FIG. 3 shows a schematic view of a second example on the mutual placing of heat exchanging coils in an apparatus according to the invention.
Figure 4:
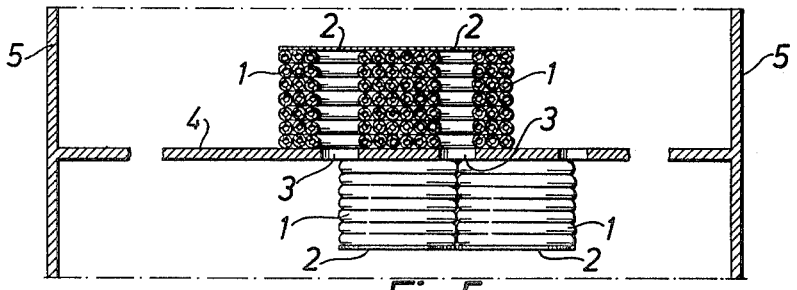
FIG. 4 shows a section taken along the line IV—IV in FIG. 3.

In FIG. 4 there is shown an apparatus in which the coils 1 are placed in a "quadratic" configuration so that those in a group comprising four coils facing the same way are placed with their centres at the corners of a square. The reference denotations in FIGS. 3 and 4 otherwise correspond to those in FIGS. 1 and 2. In the quadratic configuration according to FIGS. 3 and 4 the inside diameter d should be equal to or less than approximately 0.37, if it is desired to avoid a coil on one side of the plate screening off the cavity of a coil on the other side of the plate. In a corresponding way, the quadrangular space between four adjacent coils 1, facing the same way, should have an area which is greater than 2×the area of the cavity in a coil. This is because the total flow departing through the quadrangular space is equal to the flow through the centre of a coil + ¼ of the outflow from each of the coils abutting the quadrangular space.

Figure 5:
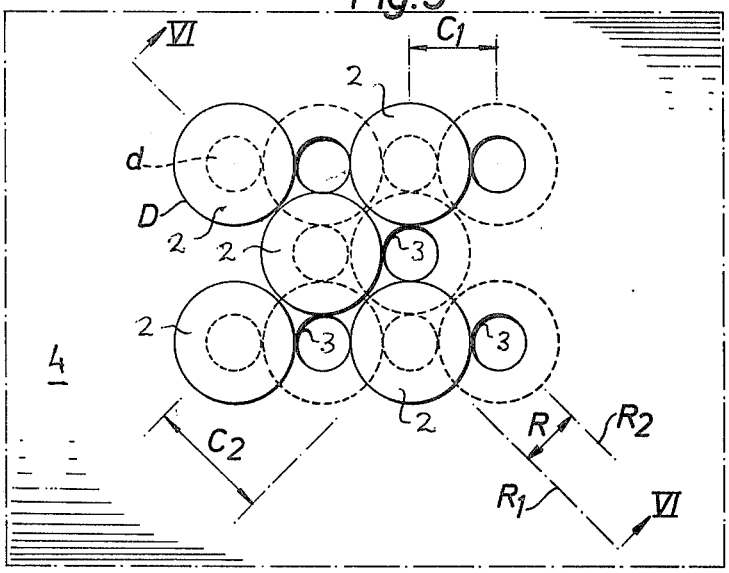
FIG. 5 shows a schematic view of a third example on the mutual placing of heat exchanging coils in an apparatus according to the invention.
Figure 6:
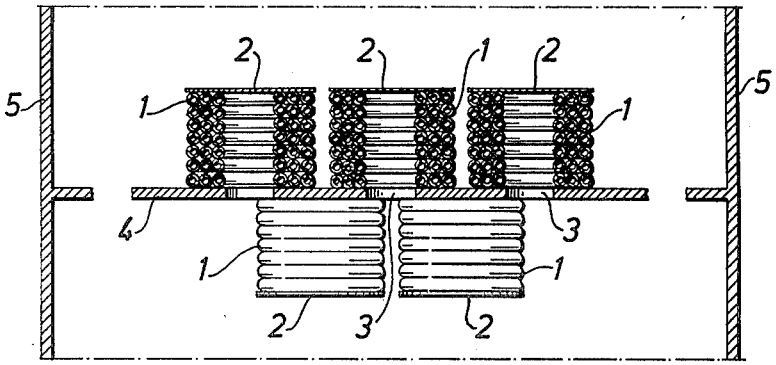
FIG. 6 shows a section taken along the line VI—VI in FIG. 5.

In FIGS. 5 and 6 there is shown a variation of the apparatus shown in FIGS. 3 and 4. As is apparent from the FIGS. 5 and 6, the coils are placed in a square configuration, although coils facing the same way are not arranged in contact with each other as is in the case in the embodiments according to FIGS. 1 and 3. The reference denotations in FIGS. 5 and 6 correspond to those in FIGS. 1–4, where applicable. In the embodiment according to FIG. 5, the inside diameter of the coil should be equal to or less than approximately 0.45×D, if it is desired to avoid a coil on one side of the plate screening off a portion of the cavity in a coil on the other side of the plate. In the embodiment according to FIGS. 5 and 6, as with the embodiment according to FIGS. 3 and 4, the space between four adjacent coils facing the same way should have an area greater than 2×the area of the cavity in a coil. Note that the arrows in FIG. 6 illustrate a flow path of a first fluid, such as air, across the heat exchange coils of the heat exchanger, and that a supply system for communicating a second fluid, in parallel, to the tubes of the heat exchange elements is also shown.

Figure 7:
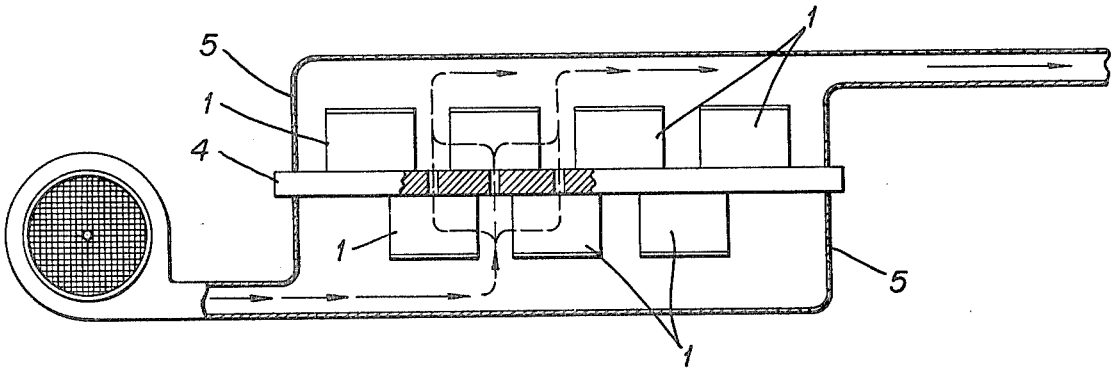
FIG. 7 is a schematic cross-sectional view of a heat exchanger according to the present invention illustrating a flow of a fluid, such as air, across the heat exchanger in a flow path from a location upstream of the heat exchange elements on a first side of a plate member to a location downstream of the heat exchange elements on a second side of the plate member.

With reference to FIG. 7, there is shown a flow path of a fluid, such as air, across a heat exchanger according to the present invention. The fluid passes through the apertures 3 of the plate member 4 into the interior of the coils provided on the second side of the plate member 4 and also passes radially through each of the coils provided on the first side of the plate member 4 and then through other apertures 3. The flows through the coils on both sides of the plate member 4 then recombine downstream of the coils.

In all re embodiments described, the orifices 3 in the plate should have a diameter substantially corresponding to d, i.e. the diameter of the cavity in a coil.

It will be further understood that all three of the described embodiments can be modified by placing the coils at a greater distance from each other, although the condition that adjacent opposed coils 1 shall overlap each other must naturally be retained. By such modifications the advantage is gained that the coils 1 can be allowed to have a relatively large inside diameter. It should however be arranged that the space between adjacent coils facing the same way can receive the aforementioned total flows without flow disturbances.

For all the described embodiments, the rows $R_1$ and $R_2$ shall be alternating and parallel, and in adjacent rows of coils 1 facing in opposite directions, the coils of one row shall be longitudinally displaced in relation to the other row a distance corresponding to half the centre-to-centre distance between the coils in a row. In the embodiment according to FIG. 1, it is also applicable that in adjacent rows of coils facing the same way, the coils in one row shall be displaced relative to the other row, in the longitudinal direction of the row, a distance corresponding to half the centre-to-centre distance between the coils in a row. In the embodiments according to FIGS. 3 and 5 it is instead applicable that in two adjacent rows of coils facing the same way that the coils of these rows are opposite each other.

Figure 8:
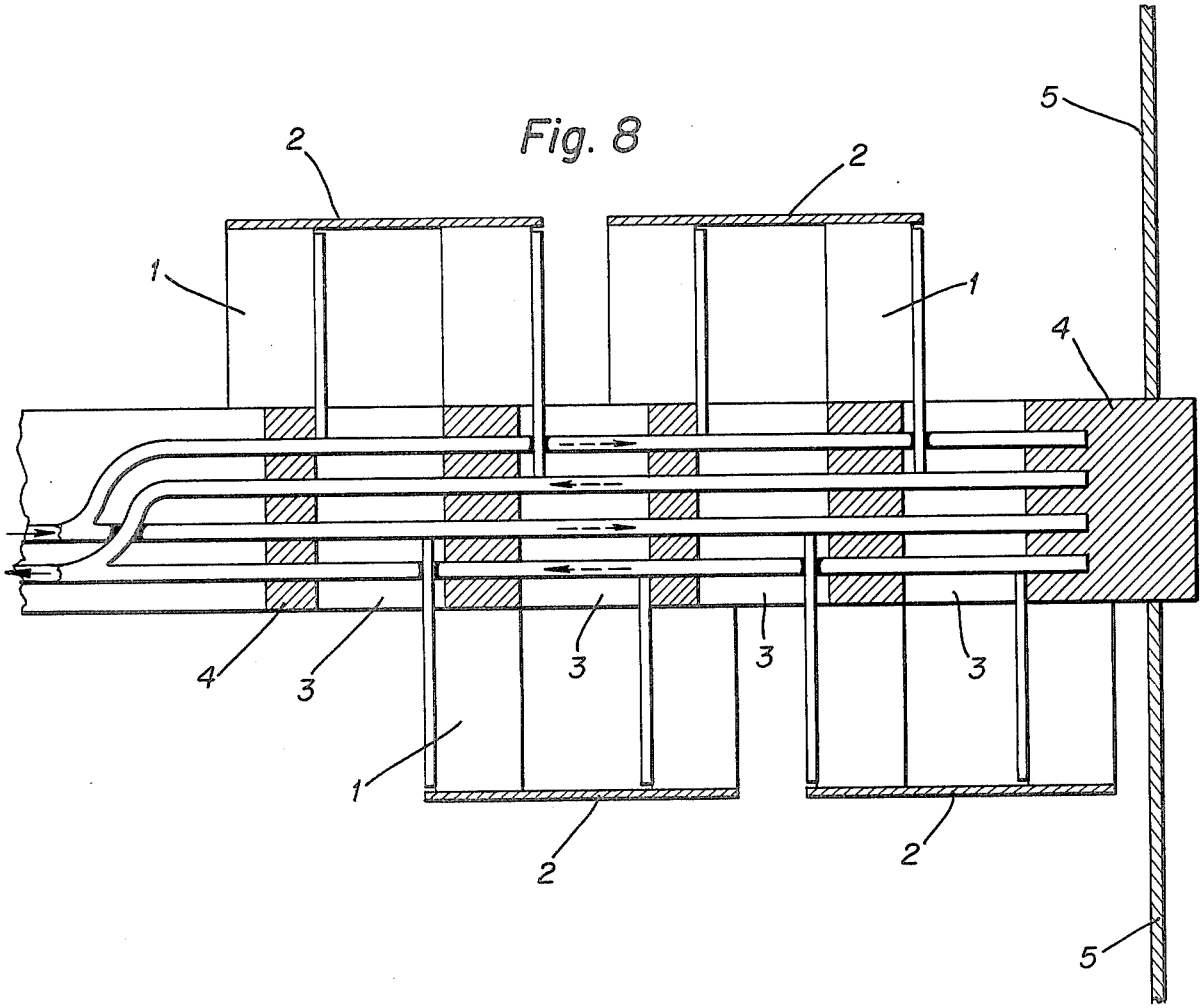
FIG. 8 is an enlarged, schematic, cross-sectional view of a portion of a heat exchanger according to the present invention, illustrating a coupling of the coils to one another in parallel.

All the coils 1 are preferably connected in parallel, as shown in FIG. 8, but other possibilities are also conceivable, e.g. that the coils on one side of the baseplate 4 are interconnected in parallel and that the coils on the other side of the plates are interconnected in parallel, these two groups then being coupled together in series.

What is claimed is:

1. In a heat exchanger apparatus comprising a plurality of heat exchanging units each consisting of a sparsely wound, hollow, substantially circular pipe coil, closed at one end, every coil having a substantially identical outside diameter (D) and inside diameter (d), said coil being placed with its open end on a plate provided with a plurality of orifices, said plate screening off a flow passage for a first fluid, and each orifice being substantially axially aligned with a coil, the improvement that said coils are provided on both sides of the plate, that the coils on one side of the plate are arranged with equal centre-to-centre distances ($C_2$) in parallel first rows ($R_1$), that the coils on the other side of the plate are arranged with said centre-to-centre distances ($C_2$) in parallel second rows ($R_2$), that the first rows ($R_1$) and the second rows ($R_2$) are parallel and alternating, that the coils of the first row ($R_1$) are displaced substantially half the said centre-to-centre distance ($C_2$) in the direction of the row relative to those in the second row, and that adjacent opposing coils overlap each other substantially without covering the orifice in the plate of one of the opposing coils on the other side of the plate, a portion of the first fluid flowing radially into the interiors of the coils on a first side of the plate and out through the orifices substantially axially aligned with said coils to a second side of the plate, and another portion of the first fluid flowing into the orifices substantially axially aligned with the coils on the second side of the plate and radially out through the coils on the second side of the plate.

2. An apparatus according to claim 1 wherein the coils are coupled to one another in parallel and further comprising:

means for supplying a second fluid through the coupled coils; and means for supplying the first fluid through the flow passage screened off by the plate.

3. A heat exchanger, comprising:

a plate member provided with a plurality of apertures;

a plurality of heat exchange elements, each heat exchange element including a sparsely wound hollow coil of pipe, said pipe having an inside and an outside, each heat exchange element being arranged with a corresponding one of the apertures with the heat exchange element of adjacent apertures being provided on opposite sides of the plate member and with each of the heat exchange elements of the adjacent apertures overlapping one another and extending completely over only one of the two adjacent apertures; and cover means for closing one end of each of the heat exchange elements, the one end being away from the plate member to establish a flow path for a fluid from a first side of the plate member upstream of the heat exchange elements to a second side of the plate member downstream of the heat exchange elements, a portion of the fluid flowing radially into the interiors of the sparsely wound coils of pipe on the first side of the plate member and out through the apertures over which the coils of pipe on the first side of the plate member are arranged to the second side of the plate member, and another portion of the fluid flowing into the apertures over which the coils on the second side of the plate member are arranged and radially out through the coils on the second side of the plate member.

4. The heat exchanger of claim 3 further comprising:

means for supplying a first fluid over the outside of each of the pipes, said first fluid traveling in said flow path from the one side of the plate member upstream of the heat exchange elements to the other side of the plate member downstream of the heat exchange elements; and means for supplying a second fluid through the inside of each of the pipes.

5. The heat exchanger of claim 3 wherein each of the heat exchanger elements is substantially identical to one another with each heat exchange element having an outside diameter (D) and an inside diameter (d) with the coils being generally cylindrical in shape, the coils being arranged on each side of the plate member with an equal center-to-center distance ($C_2$) between adjacent coils.

6. The heat exchanger of claim 5 wherein the coils on the first side of the plate member are arranged in parallel first rows ($R_1$) and the coils on the second side of the plate member are arranged in parallel second rows ($R_2$) the second rows being parallel to the first rows and alternating therewith, the coils of the first rows ($R_1$) being displaced substantially half of the center-to-center distance ($C_2$) in the direction of the adjacent row of the second rows.

7. The heat exchanger of claim 6 or claim 1 wherein the coils are arranged so that $C_1$, $C_2$ and R have values meeting the following relationships:

$$\frac{D+d}{2} \leqq C_1 < D \quad D \leqq C_2 < D\sqrt{3} \quad \frac{D\sqrt{3}}{6} \leqq R < \frac{D}{2}$$

where d = the cavity diameter of the coil at the open end thereof,

D = the outside diameter of the coil at the closed end thereof, $C_1$ = Centre-to-centre distance between adjacent opposing, coils, $C_2$ = Centre-to-centre distance between coils facing the same way in a row, R = Centre-to-centre distance between one of the first rows and one of the second rows adjacent to the one first row.

8. The heat exchanger of claim 7 wherein the coils are arranged so that $C_1$, $C_2$ and R have values meeting the following relationships:

$$C_1 = \frac{D+d}{2} \quad C_2 = D \quad R = \frac{D\sqrt{3}}{6} \quad d \leqq \frac{D(2-\sqrt{3})}{\sqrt{3}}$$

9. The heat exchanger of claim 8 wherein the coils are further arranged so that $$\frac{D+d}{2} \leqq C_1 < D \quad D \leqq C_2 < D\sqrt{2} \quad \frac{D}{2} \leqq R < \frac{D}{\sqrt{2}}$$

10. The heat exchanger of claim 9, wherein the coils are further arranged so that $$C_1 = \frac{D+d}{2} \quad C_2 = D \quad R = \frac{D}{2} \quad d \leqq D(\sqrt{2}-1)$$

11. The heat exchanger of claim 9, wherein the coils are further arranged so that $$C_1 = \frac{D+d}{2} \quad C_2 = \frac{D3\sqrt{2}}{2} \quad R = \frac{D3}{4\sqrt{2}} \quad d \leqq \frac{D}{2}$$

12. The heat exchanger of claim 7, wherin the coils are further arranged so that $$d^2 \leqq \frac{8}{3\pi}\left(\frac{3C_2R}{2} - \frac{\pi D^2}{8}\right)$$

13. The heat exchanger of claim 9, wherein the coils are further arranged so that $$d^2 \leqq \frac{2}{\pi}\left(2C_2R - \frac{\pi D^2}{4}\right)$$

* * * * *